US005984133A

United States Patent [19]

Schutz

[11] Patent Number: 5,984,133

[45] **Date of Patent: *Nov. 16, 1999**

[54] TIGHTHEAD BARREL

[75] Inventor: Udo Schutz, Selters, Germany

[73] Assignee: Schutz-Werke GmbH & Co. KG, Selters, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/844,344

[22] Filed: Apr. 18, 1997

[30] Foreign Application Priority Data

Mar. 10, 1997 [DE] Germany ..... 197 09 536

[51] Int. Cl.[6] ..... B65D 6/40

[52] U.S. Cl. ..... 220/601; 206/509; 220/608; 220/672

[58] Field of Search ..... 220/672, 601, 220/608, 675, 4.04, 4.05, 4.06, DIG. 1, 605; 206/509, 503, 508

[56] References Cited

U.S. PATENT DOCUMENTS

| | | | |
|---|---|---|---|
| 2,354,425 | 7/1944 | Kuhn | 220/601 |
| 3,701,455 | 10/1972 | Warnecke | 206/509 |
| 4,674,648 | 6/1987 | Przytulla | 220/601 |
| 4,767,021 | 8/1988 | Pies | 220/601 |
| 4,776,479 | 10/1988 | Schutz | 220/601 |
| 4,934,551 | 6/1990 | Budenbender | 220/601 |
| 4,941,584 | 7/1990 | Bowers et al. | 220/601 |
| 5,217,142 | 6/1993 | Schutz | 220/601 |
| 5,273,181 | 12/1993 | Gay | 220/601 |

FOREIGN PATENT DOCUMENTS 0 324 882 7/1989 European Pat. Off. .

*Primary Examiner*—Stephen P. Garbe
*Assistant Examiner*—Niki M. Eloshway
*Attorney, Agent, or Firm*—Young & Thompson

[57] ABSTRACT

Tighthead barrel (1) is blow molded from thermoplastic. Top (4) which is arched to the outside has dome shape (9) and with its outside edge (10) at distance (a) under bearing surface (7) of carrying and rolling ring (5) which is pointed perpendicularly or obliquely to barrel axis (6—6) at a steep slant angle runs into top end section (11) of barrel jacket (2). Carrying and rolling ring (5) projects upward in the direction of barrel axis (6—6) above crown (16) of top (4). Arched stacking surface (17) of top (4) passes into two ramp-like deck sections (19, 20), which border deck surface (18) of recess (12) for filler and drain plug (14), which emerge in the peripheral direction of the top, and which run with a slight gradient from central stacking surface (17) of top (4) to deck surface (18) of recess (12) for filler and drain plug (14) and via which in the slightly tilted head position of tighthead barrel (1) the residual liquid which emerges through hole (25) of filler and drain plug (14) and which collects on inside (23) of top (4) drains, ramp-like deck sections (19, 20) being made as bridges and forming gutters (21, 22) which run on outside edge (10) of top (4).

1 Claim, 7 Drawing Sheets

Fig. 2
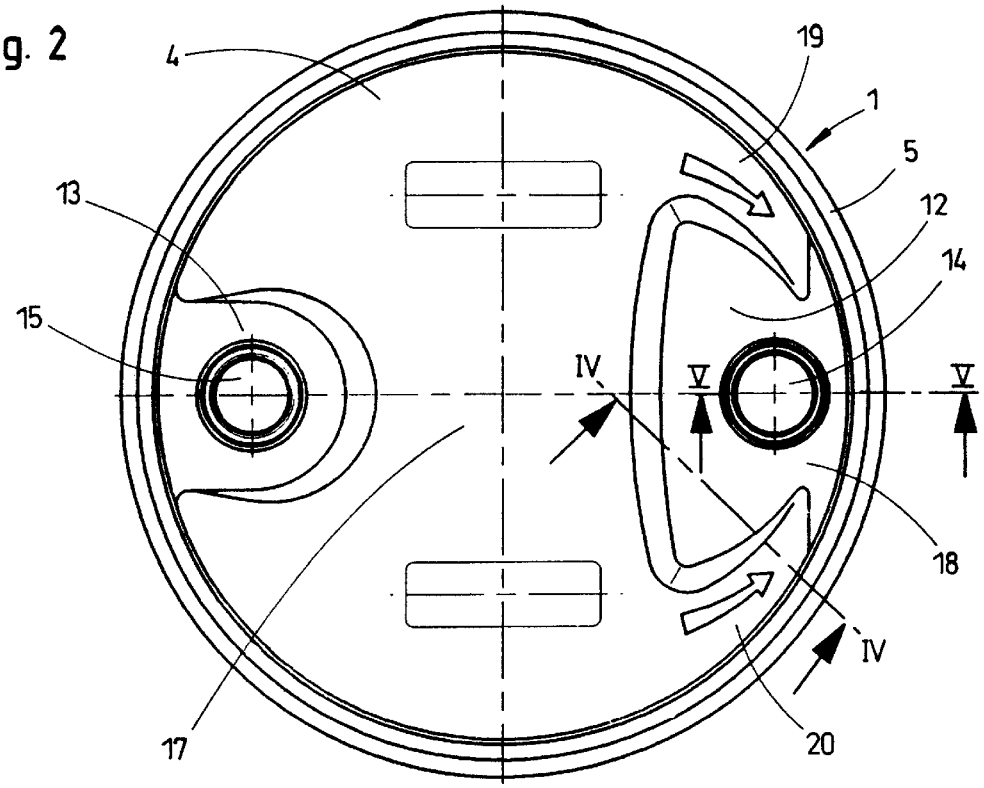
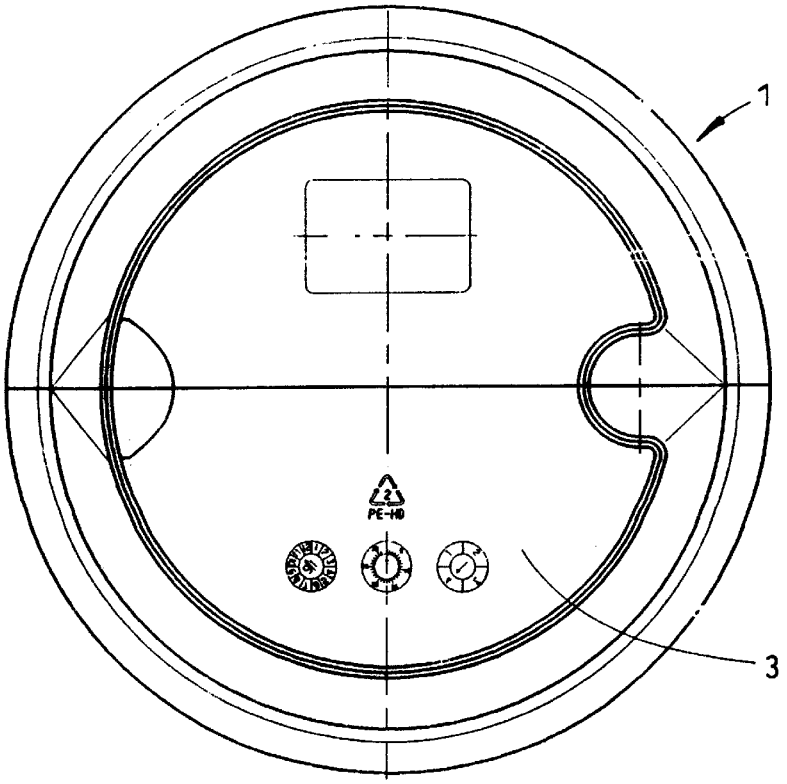
Fig. 3

TIGHTHEAD BARREL

BACKGROUND OF THE INVENTION

The invention relates to thermoplastic tighthead barrels for storage and transport of liquids, which are produced in one piece by blow molding, with a cylindrical barrel jacket, a bottom and a top with molded-in recesses for embedded arrangement of a filler and drain plug and a vent plug and with a carrying and rolling ring which is molded to the barrel jacket and which surrounds the top and has an annular bearing surface which is pointed vertically or obliquely to the barrel axis and which is freely accessible from the outside, and a cylindrical or slightly conical bearing surface which is concentric to the barrel axis and which is freely accessible from the top, for the gripper arm of a barrel gripper.

DESCRIPTION OF THE RELATED ART

EP 0 324 882 P2 discloses tighthead barrels of this type which have a top formed as a flat deck, with a stacking surface which is aligned with the upper edge surface of the carrying and rolling ring.

The disadvantage of this known tighthead barrel is the bending stresses on which tensile stresses are superimposed, and which load the flat top, which is deleterious in terms of production engineering, at an overpressure in the barrel which is produced by the vaporization of liquid content. Increased overpressure which acts over longer time intervals can cause creep phenomena of the plastic which can lead to weakening of the top so that upon unintentional striking of the top of the barrel against a ground surface for example when the barrel falls from a relatively great height when loading, the top can be struck such that liquid leaks out of the barrel.

Another disadvantage of this known tighthead barrel is that in a slightly tilted head position of the barrel viscous media drain out too slowly when residue is being emptied.

SUMMARY OF THE INVENTION

The object of the invention is to develop the generic tighthead barrel to impart greater stability, increased transportation safety and optimum residue emptying capacity.

This object is achieved according to the invention by a tighthead barrel with the features of patent claim 1.

The tighthead barrel according to the invention is characterized compared to the generic tighthead barrel by greater stability and transportation safety which are achieved by the dome shape of the top, and by significantly improved reside emptying capacity by the gutters which run on the inner edge of the top.

BRIEF DESCRIPTION OF THE DRAWINGS

The invention is explained below using drawings which in particular shown the following.

DESCRIPTION OF THE PREFERRED EMBODIMENTS

Figure 1:
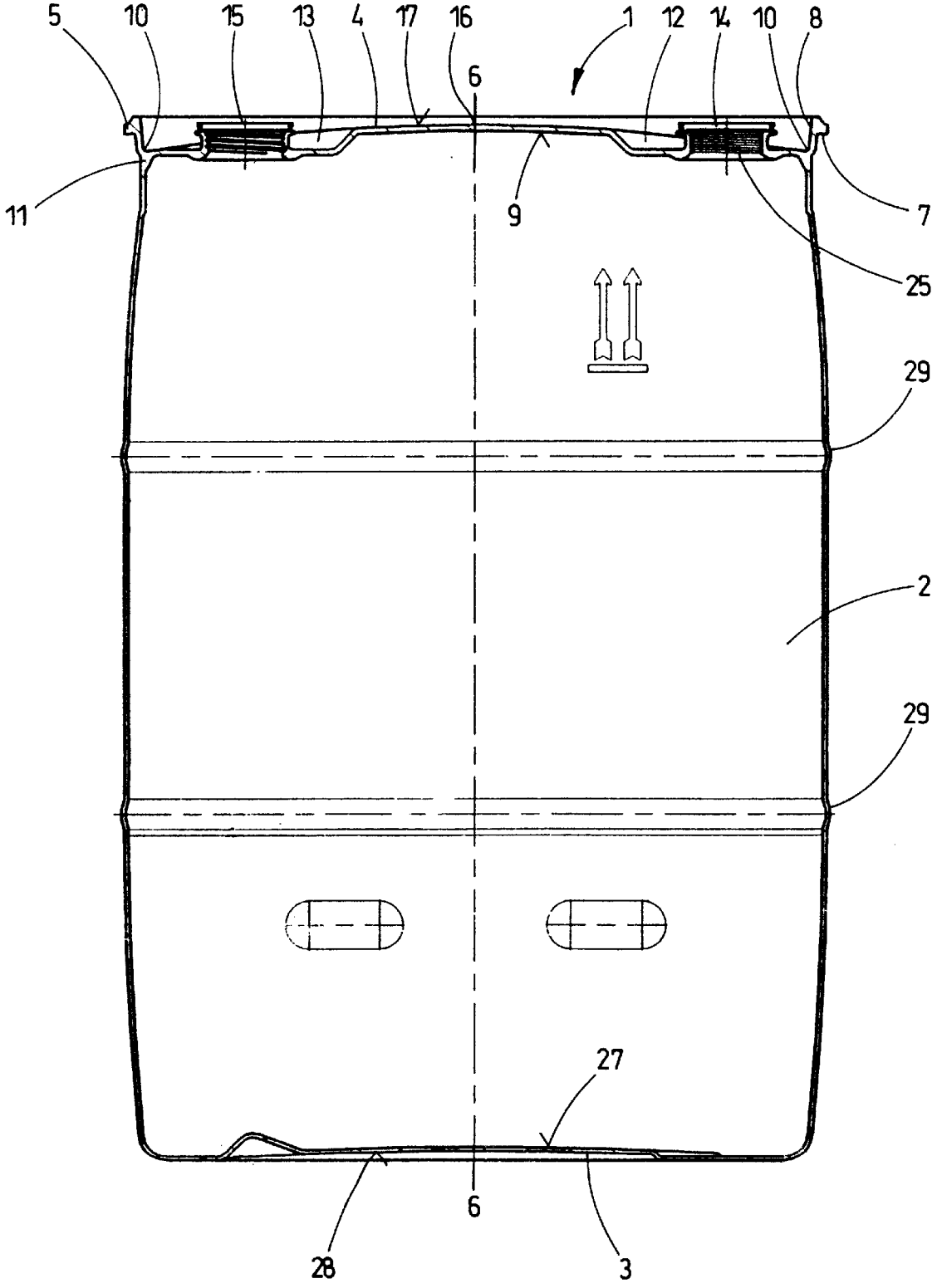
FIG. 1 longitudinal section through the tighthead barrel according to the invention, FIG. 2 an overhead view, FIG. 3 a view of the tighthead barrel from underneath, FIG. 4 a section according to line IV—IV of FIG. 2 in an enlarged representation, FIG. 5 a partial section through the top and bottom of two stacked tighthead barrels in an enlarged view according to line V—V of FIG. 2, FIG. 6 the top in a longitudinal section in the residue emptying position of the tighthead barrel, FIG. 7 two tighthead barrels stacked on top of one another in a side view and FIG. 8 a side view of a stack of pallets with tighthead barrels standing on them.
Figure 4:
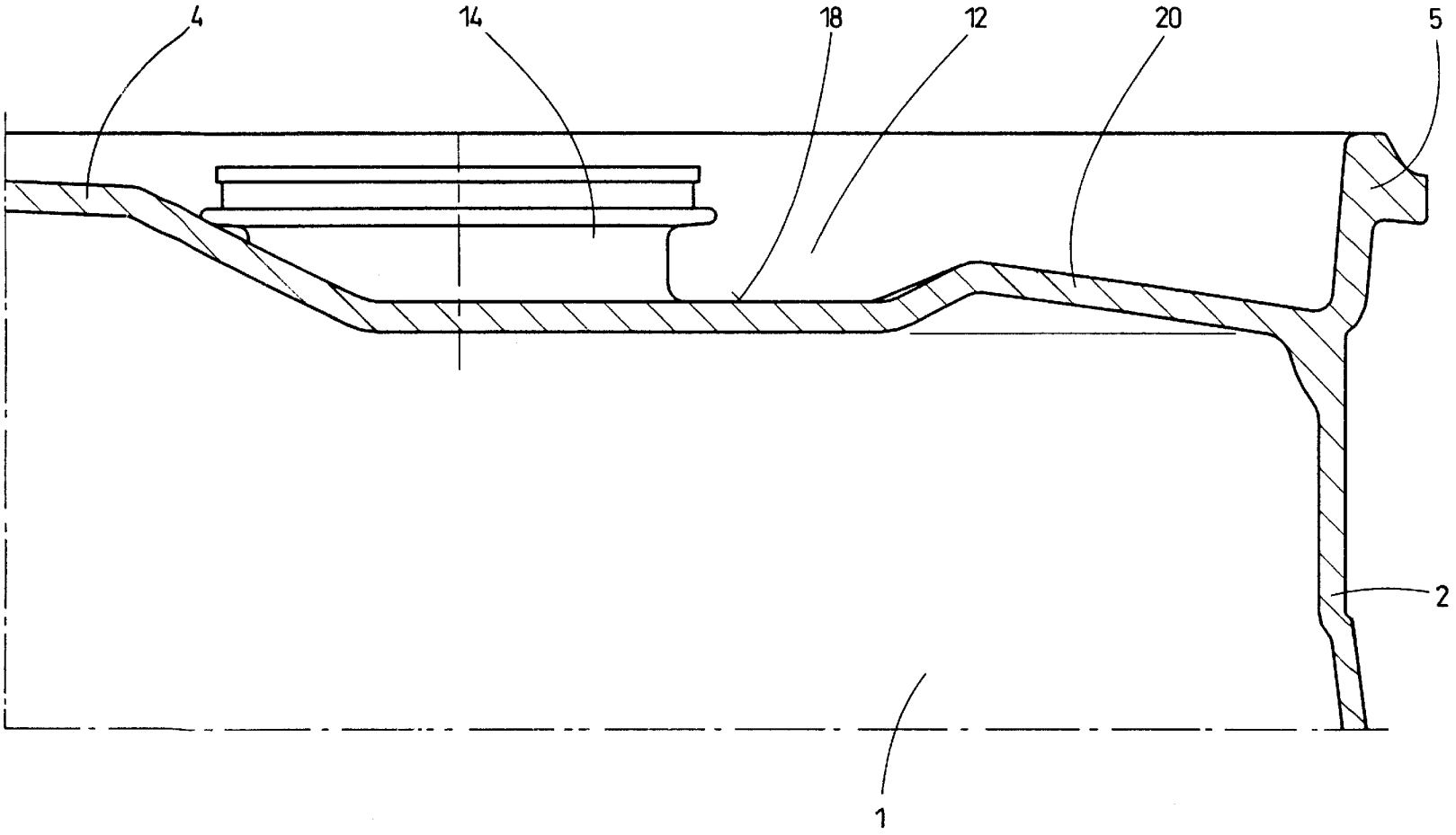

Thermoplastic tighthead barrel 1 blow molded in one piece according to FIGS. 1 through 3 consists of cylindrical barrel jacket 2, bottom 3 and top 4.

Carrying and rolling ring 5 is molded onto barrel jacket 2, surrounds top 4 and has annular bearing surface 7 which is pointed perpendicularly to barrel axis 6—6 and which is freely accessible from the outside, and bearing surface 8 which flares slightly conically to the outside, which is concentric to barrel axis 6—6, and which is freely accessible from the top, for the gripper arms of a barrel gripper.

Figure 5:
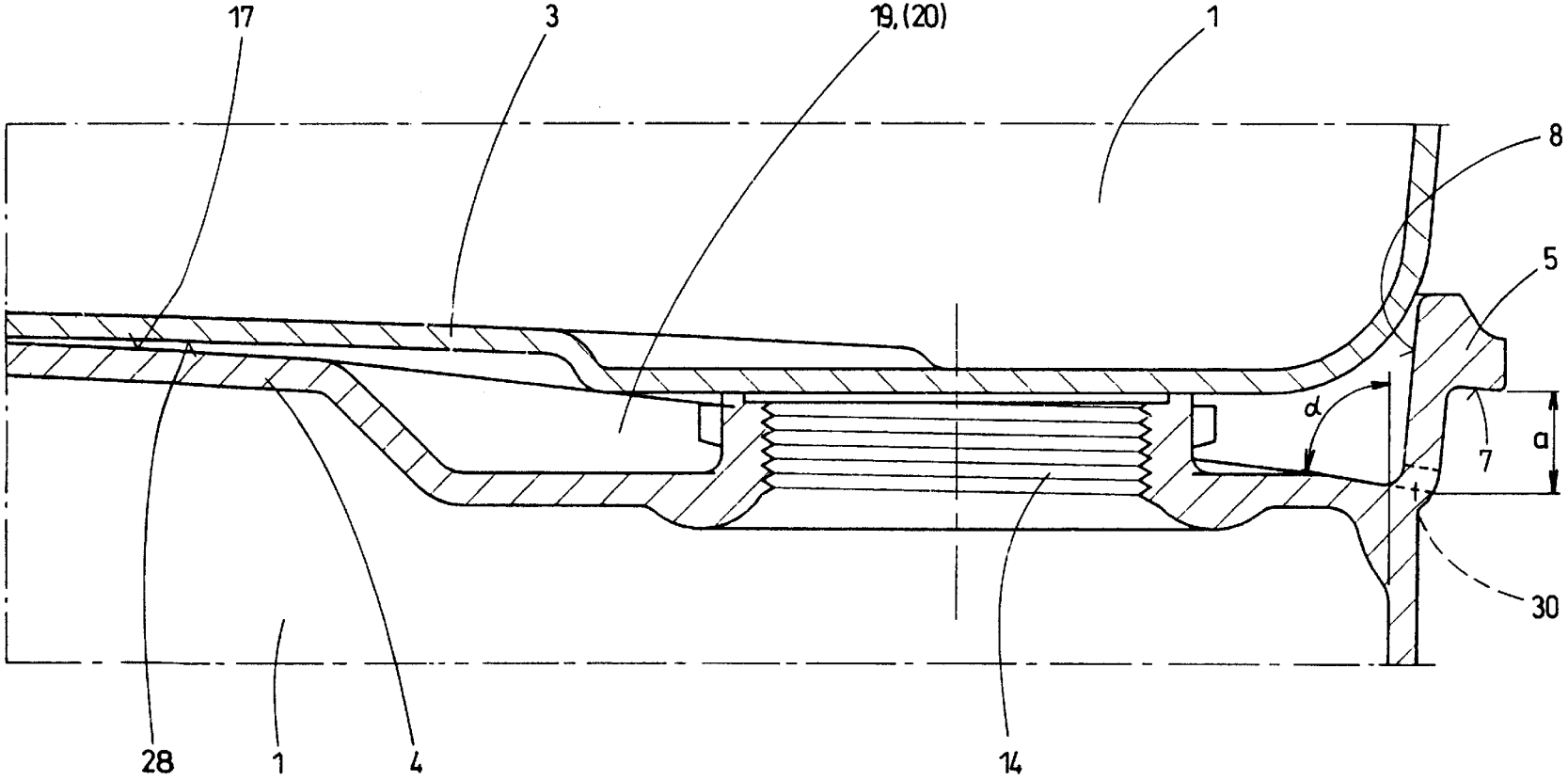

Top 4 which is convexly arched to the outside has dome shape 9 and runs with its outside edge 10 to form a joining line, at outside edge 10, with carrying and rolling rings and an upper end section of the barrel jacket 2 with distance a under bearing surface 7 of carrying and rolling ring 5 pointed perpendicularly to barrel axis 6—6 at a steep slant angle a into upper end section 11 of barrel jacket 2 (FIGS. 1 and 5).

Dome shape 9 of top 4 results in its being exposed essentially only to peripheral and tensile stresses with an overpressure in the barrel and its being largely relieved of bending stresses.

Recesses 12, 13 are molded into top 4 for embedded arrangement of filler and drain plug 14 and vent plug 15 which are closed by means of tighthead plugs made as screw plugs and which are not shown.

Carrying and rolling ring 5 projects upward in the direction of barrel axis 6—6 over crown 16 of top 4.

Arched stacking surface 17 of top 4 passes into two ramp deck sections 19, 20, which border deck surface 18 of recess 12 for filler and drain plug 14, which emerge in the peripheral direction of the top, and which run with a slight gradient from central stacking surface 17 of top 4 to deck surface 18 of recess 12 for filler and drain plug 14.

Figure 6:
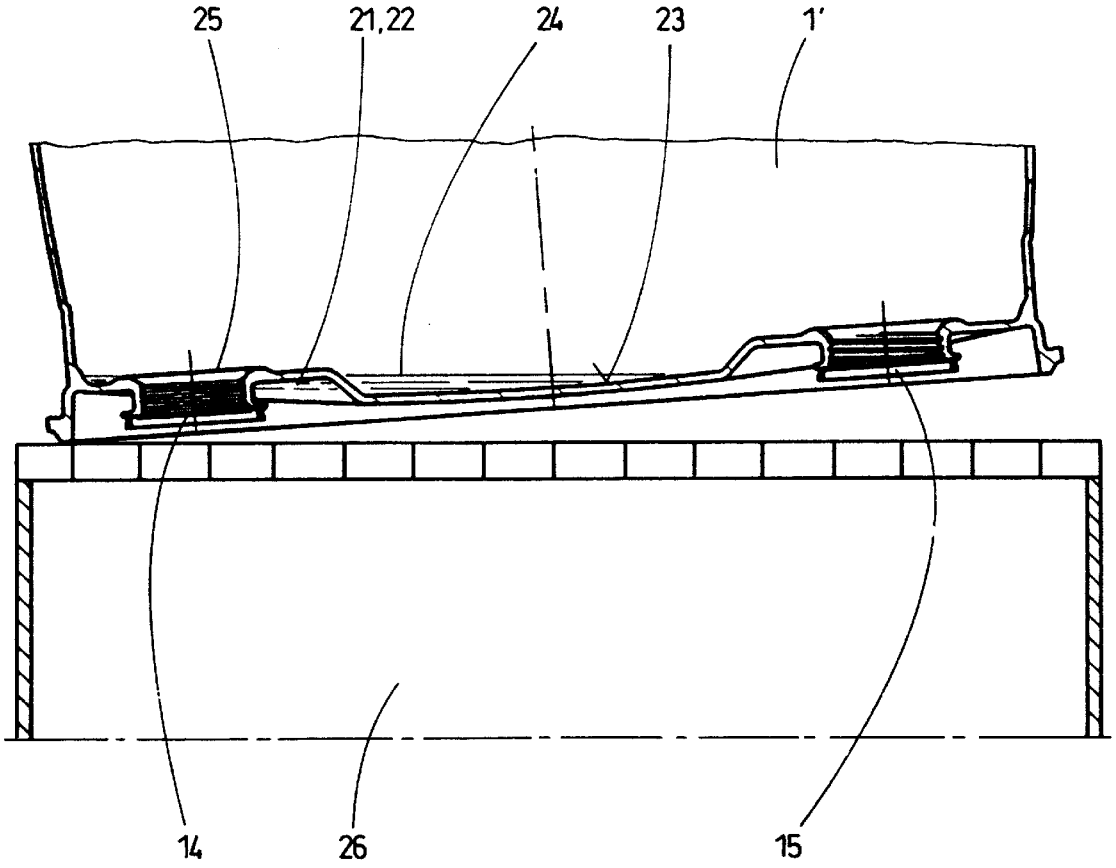
Figure 7:
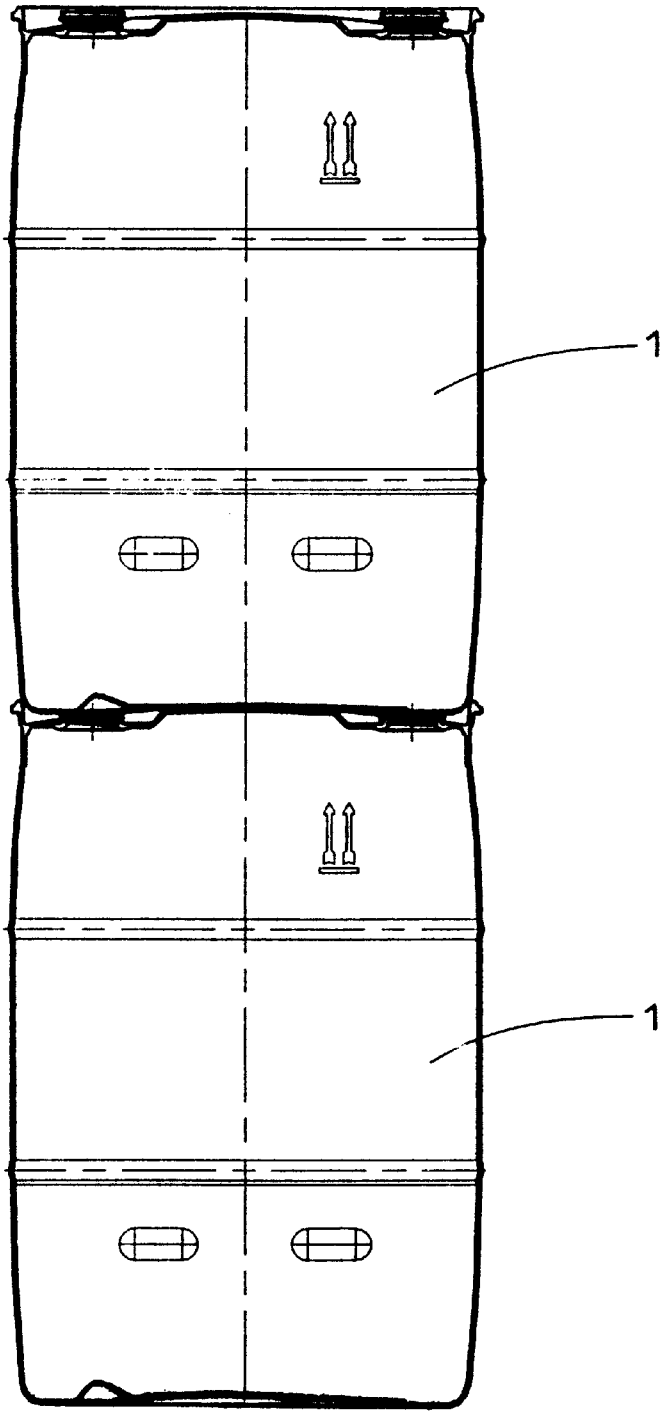

In slightly tilted head position 1' of tighthead barrel 1 according to FIG. 6 deck sections 19, 20 of top 4 form gutters 21, 22 which run on outside edge 10 of the top for residual liquid 24 which collects on inside 23 of top 4 and which runs along the inside wall of top 4 and drains through plug hole 25 of filler and drain plug 14 into collection vessel 26.

Bottom 3 which is arched concavely into the interior of the barrel has dome shape 27 which corresponds to dome shape 9 of top 4 and for stacking purposes has arched central seating surface 28 which corresponds to arched stacking surface 17 of top 4. When two barrels 1 are stacked, upper barrel 1 with bottom 3 fits into carrying and rolling ring 5 of lower barrel 1 and is seated with seating surface 28 of bottom 3 on stacking surface 17 of top 4 of lower barrel 1.

Rolling rings 29 are molded out of barrel jacket 2.

Rainwater and melt water which collect on top 4 can drain via drain holes 30 in carrying and rolling ring 5 (FIG.

Figure 8:
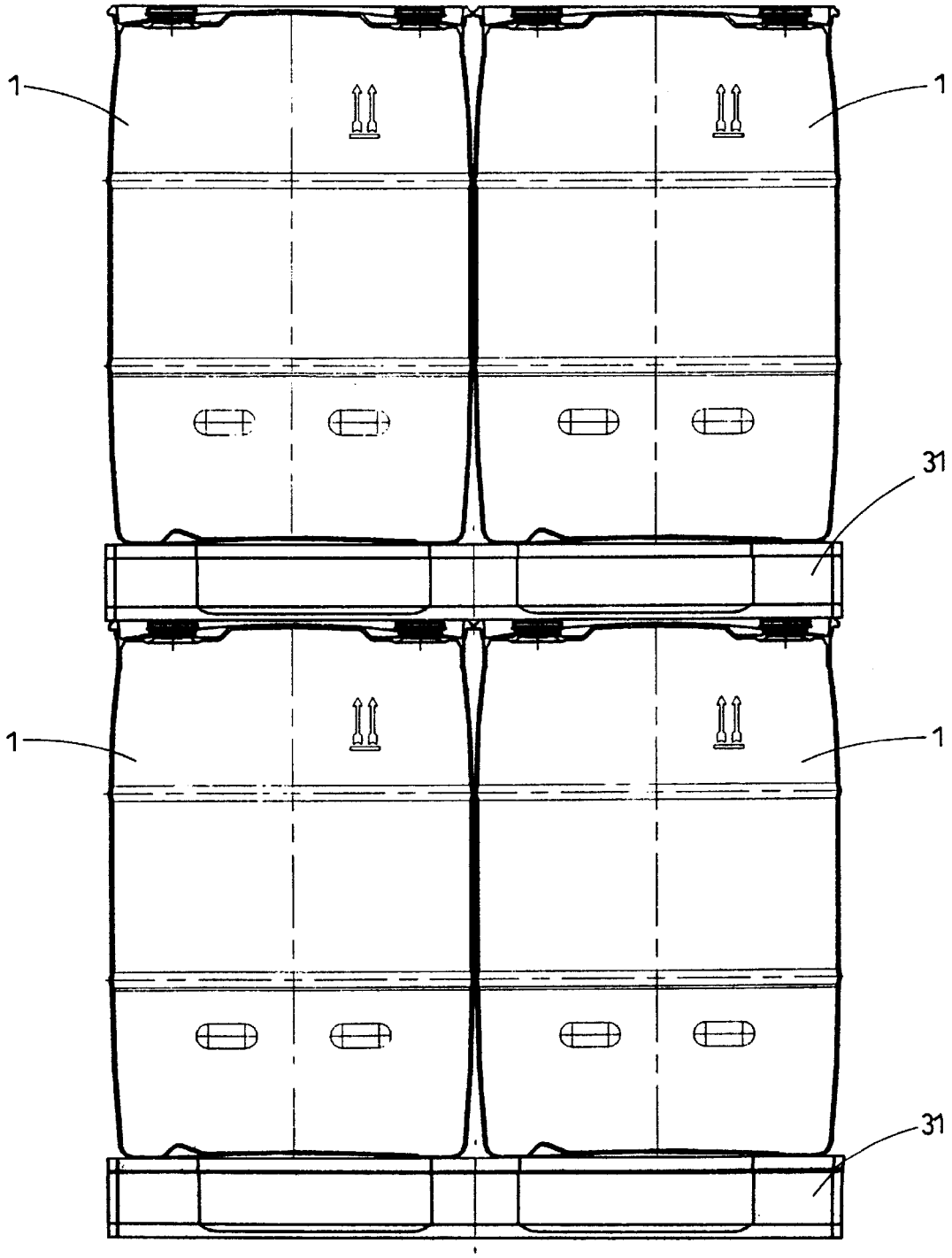

The embedded arrangement of arched top 4 in carrying and rolling ring 5 enables pallets 31 with tighthead barrels 1 to be stacked on top of one another, as FIG. 8 shows.

I claim:

1. A one-piece, blow-molded, tight-head thermoplastic barrel for storage and transport of liquid comprising:

a cylindrical barrel jacket;

a base; and a top, said top comprising molded-in depressions for a countersunk arrangement of a filling and emptying bung and a venting bung, and a carrying and rolling ring molded onto said barrel jacket at an upper end section of said barrel jacket, said carrying and rolling ring defining an outer perimeter of said top and comprising an annular contact surface at a perpendicular or oblique angle to a barrel axis and being freely accessible from the outside, and a cylindrical or conical contact surface concentric to the barrel axis and being freely accessible from said top for gripper arms of a barrel gripper, said top forming an arched central stacking surface adjacent two adjacent ramp bottom sections bordering a bottom surface of said depression for said filling and emptying bung, said ramp bottom sections running outwardly in a peripheral direction of said top with a gradient from said stacking surface to said bottom surface, said ramp bottom sections being designed and constructed so that when said barrel is in a tilted head position any residual liquid which collects on an interior side of said top runs via said ramp bottom sections to a bunghole of said filling and emptying bung, said ramp bottom sections being made as bridges and forming drain troughs which run on the outside edge of said top, said arched central stacking surface of said top (4) being arched convexly to the outside of said barrel to have a dome shape (9) portion joining said carrying and rolling ring and said upper end section at a joining line (10), said contact surface (7) of said carrying and rolling ring being located a fixed distance (a) above said joining line so that said carrying and rolling ring projects upwardly at the perpendicular or oblique angle in the general direction of the barrel axis over an apex (16) of said dome shape portion of said top, said base (3) being arched concavely into an interior of the barrel to provide a base dome shape portion (27) which corresponds to said top dome shape (9) portion, said base dome shape portion comprising an arched central seating surface (28) corresponding to said arched central stacking surface (17) of said top, said base (3) further comprising two essentially horizontal seating portions positioned to correspond to upper surfaces of said filling and emptying bung (14) and said venting buns (15) designed and adapted so that when a first of said barrel is resting on a second of said barrel said upper surfaces of said filling and emptying bung (14) and said venting bung (15) support said base (3) at said seating portions.

* * * * *